US005960868A

United States Patent [19]

Kuriyama et al.

[11] Patent Number: 5,960,868

[45] Date of Patent: Oct. 5, 1999

[54] ADIABATIC APPARATUS

[75] Inventors: Toru Kuriyama; Masahiko Takahashi, both of Kanagawa-ken; Rohana Chandratilleke, Tokyo; Yasumi Ohtani, Kanagawa-ken; Hideki Nakagome, Tokyo, all of Japan

[73] Assignee: Kabushiki Kaisha Toshiba, Kawasaki, Japan

[21] Appl. No.: 09/022,886

[22] Filed: Feb. 12, 1998

[30] Foreign Application Priority Data

Feb. 25, 1997 [JP] Japan ..... PO9-040569

[51] Int. Cl.[6] ..... F28F 13/00

[52] U.S. Cl. ..... 165/135; 165/277; 62/51.1

[58] Field of Search ..... 165/135, 277; 62/51.1

[56] References Cited

U.S. PATENT DOCUMENTS

| | | | |
|---|---|---|---|
| Re. 33,419 | 11/1990 | White | 62/51.1 |
| 1,708,387 | 4/1929 | Bramwell | 165/135 |
| 4,212,346 | 7/1980 | Boyd | 165/277 |
| 4,689,970 | 9/1987 | Ohguma et al. | 62/51.1 |
| 4,790,147 | 12/1988 | Kuriyama et al. | 62/51.1 |
| 4,959,964 | 10/1990 | Saho et al. | 62/51.1 |
| 4,986,077 | 1/1991 | Saho et al. | 62/51.1 |
| 5,018,359 | 5/1991 | Horikawa et al. | 62/51.1 |
| 5,086,834 | 2/1992 | Grandi | 165/135 |
| 5,535,815 | 7/1996 | Hyman | 165/277 |
| 5,842,348 | 12/1998 | Kaneko et al. | 62/51.1 |

FOREIGN PATENT DOCUMENTS 4-116907 4/1992 Japan .

*Primary Examiner*—Ira S. Lazarus
*Assistant Examiner*—Tarrall McKinnon
*Attorney, Agent, or Firm*—Oblon, Spivak, McClelland, Maier & Neustadt, P.C.

[57] ABSTRACT

In the adiabatic apparatus of the present invention, a vessel includes an adiabatic layer in which an object is taken. A plurality of thermal shield plates are located in the adiabatic layer. Each thermal shield plate concentrically surrounds the object. A temperature control section cools or heats the object and the plurality of thermal shield plates. A switch section thermally connects the temperature control section to the plurality of thermal shield plates and the object if temperature of the plurality of thermal shield plates and the object is controlled, and thermally separates the temperature control section from the plurality of thermal shield plates and the object if control of the temperature of the plurality of thermal shield plates and the object is completed.

14 Claims, 10 Drawing Sheets

ADIABATIC APPARATUS

FIELD OF THE INVENTION

The present invention relates to an adiabatic apparatus to maintain an object such as a cold reserved object or a heat reserved object at predetermined temperature for a long time.

BACKGROUND OF THE INVENTION

Recently, various kinds of cryogenic equipments are used. A representative one is superconductive magnet mainly used in MRI. In the superconductive magnet shown in FIG. 1, a coolant vessel 2 is located in vacuum vessel 1. Liquid helium 3 as coolant is taken in the coolant vessel 2. A superconductive coil 4 is located in the liquid helium 3 to cool the coil as dunk cooling method. However, in this method, the liquid helium is necessary to be supplied in the coolant vessel in case the liquid helium is evaporated. In general, a thermal shield plate 5 is set as surrounding the coolant vessel 2 and cooled by a refrigerator 6. In order to suppress the evaporation of the liquid helium 3, heat leakage is absorbed by radiation of the thermal shield plate 5. In this method, interval of supply of the liquid helium 3 becomes long, but the supply of the liquid helium is also necessary.

As another method shown in FIG. 2, the superconductive coil 4 is directly cooled by a cryogenic refrigerator 7 without the liquid helium. This method is realized by a reason that the cryogenic refrigerator 7 is greatly developed. For example, small size refrigerator such as GM (Giford Macmaphone) can cools the coil till temperature of the liquid helium. In this superconductive magnet of conductive cooling, the liquid helium is not necessary to be supplied, construction of apparatus is simple and cost becomes low. FIG. 3 shows another example of superconductive magnet of conductive cooling. In FIG. 3, GM refrigerator of two-stage expansion method is used as cryogenic refrigerator 7. The thermal shield plate 5 is cooled to 70 K by the first cooling stage 8 and the superconductive coil 4 is cooled to 4 K by the second cooling stage 9. Furthermore, heat conduction member 10 thermally connects the second cooling stage 9 and the superconductive coil 4. In this construction, size of the superconductive magnet becomes to be one third in comparison with that of dunk cooling method. However, in this method, vibration occurred by the cryogenic refrigerator 7 is conveyed to the superconductive coil 4 and it takes a long time to cool from a normal temperature to a fixed temperature. Furthermore, minitualization of all of the apparatus has a limit because the cryogenic refrigerator 7 is necessary to be used.

As a new cooling method to solve these problems, present inventors made a proposal of cool accumulation method as shown in FIG. 4(Japanese Patent Application PH8-61458). In this method, cooling apparatus is divided into a cooling unit 16 of the cryogenic refrigerator 7 and a cold reserved unit 12 of the vacuum vessel 1 to store the superconductive coil 4. While the superconductive coil 4 is cooled till superconductive transition temperature and transferred to persistent current mode, the superconductive coil 4 and the thermal shield plate 5 are cooled by thermally connecting to the cooling unit 11 through heat conduction members 13, 14. When cooling is completed, the cooling unit 11 is separated from the cold reserved unit 12 to be used by itself. As the heat conductive members 13, 14, thermal connection method through expansion wall without vacuum break of the cooling unit 11 and the cold reserved unit 11, or thermal connection method by combination of the expansion wall and vacuum value is considered. In this method, vibration of the refrigerator does not occur and electric source is not necessary because the cooling unit 11 is separated from the cold reserved unit 12. Furthermore, one cooling unit 11 is commonly used for a plurality of cold reserved unit 12. All of apparatus is minitualized because only the cold reserved unit 12 is set to be used in actual spot.

As mentioned-above, the cool accumulation method has lots of merits. However, it is a problem that cold reserved time (adiabatic time) of the cold reserved unit 12 is limited. In normal apparatus, continuous working is required such as at least plural days, if possible, plural years. In short, a technical problem how the cold reserved time(adiabatic time) is prolonged is still remained.

SUMMARY OF THE INVENTION

It is an object of the present invention to provide an adiabatic apparatus which the adiabatic time is sufficiently prolonged without a large size of the apparatus and a complicated construction.

According to the present invention, there is provided an adiabatic apparatus, comprising: a vessel including an adiabatic layer in which an object is taken; a plurality of thermal shield plates located in the adiabatic layer, each of which concentrically surrounds the object in order; temperature control means for cooling or heating the object and the plurality of thermal shield plates; and switch means for thermally connecting said temperature control means to the plurality of thermal shield plates and the object if temperature of the plurality of thermal shield plates and the object is controlled, and for thermally separating said temperature control means from the plurality of thermal shield plates and the object if control of the temperature of the plurality of thermal shield plates and the object is completed.

Further in accordance with the present invention, there is also provided an adiabatic apparatus, comprising: a vessel including an adiabatic layer in which an object is taken; a plurality of thermal shield plates located in the adiabatic layer, each of which concentrically surrounds the object in order; temperature control means including at least one temperature control stage for cooling or heating at predetermined temperature; and switch means for thermally connecting said one temperature control stage to the plurality of thermal shield plates and the object if temperature of the plurality of thermal shield plates and the object is controlled, and for thermally separating said one temperature control stage from the plurality of thermal shield plates and the object if control of the temperature of the plurality of thermal shield plates and the object is completed.

Further in accordance with the present invention, there is also provided an adiabatic apparatus, comprising: a vessel including an adiabatic layer in which an object is taken; a plurality of thermal shield plates located in the adiabatic layer, each of which concentrically surrounds the object in order; a tube guided from outside to the vessel, located to thermally connect the plurality of thermal shield plates to the object, and guided to the outside; medium supply means connected to one side of said tube, for supplying temperature control medium; and heat exchange means located to thermal connected part of said tube, for exchanging heat between the plurality of thermal shield plates and the object by supplying the temperature control medium into said tube if temperature of the plurality of thermal shield plates and the object is controlled, and for adiabating between the plurality of thermal shield plates and the object by stopping supply of the temperature control medium if control of the temperature of the plurality of thermal shield plates and the object is completed.

Further in accordance with the present invention, there is also provided an adiabatic apparatus, comprising: a vessel including an adiabatic layer in which a liquid storage vessel is taken; a plurality of thermal shield plates located in the adiabatic layer, each of which concentrically surrounds the liquid storage vessel in order; a supply tube guided from outside to the vessel, located to thermally connect to the plurality of thermal shield plates, and guided to the liquid storage vessel; a exhaust tube guided from the vessel to the outside; medium supply means for supplying temperature control medium into said supply tube; and heat exchange means located to thermal connected part of said supply tube, for exchanging heat between the plurality of thermal shield plates and said supply tube by supplying the temperature control medium into said supply tube if temperature of the plurality of thermal shield plates and the object is controlled, and for adiabating between the plurality of thermal shield plates and said supply tube by stopping supply of the temperature control medium if control of the temperature of the plurality of thermal shield plates and the object is completed.

Further in accordance with the present invention, there is also provided an adiabatic apparatus, comprising: a vessel including an adiabatic layer in which a liquid storage vessel is taken; a plurality of thermal shield plates located in the adiabatic layer, each of which concentrically surrounds the liquid storage vessel in order; a supply tube guided from outside to the liquid storage vessel through said vessel and the plurality of thermal shield plates: temperature control mears including at least one temperature control stage for cooling or heating at predetermined temperature; and switch means for thermally connecting said one temperature control stage to the plurality of thermal shield plates and the liquid storage vessel if temperature of the plurality of thermal shield plates and the liquid storage vessel is controlled, and for thermally separating said one temperature control stage from the plurality of thermal shield plates and the liquid storage vessel if control of the temperature of the plurality of thermal shield plates and the liquid storage vessel is completed.

DETAILED DESCRIPTION OF THE PREFERRED EMBODIMENT

Figure 1:
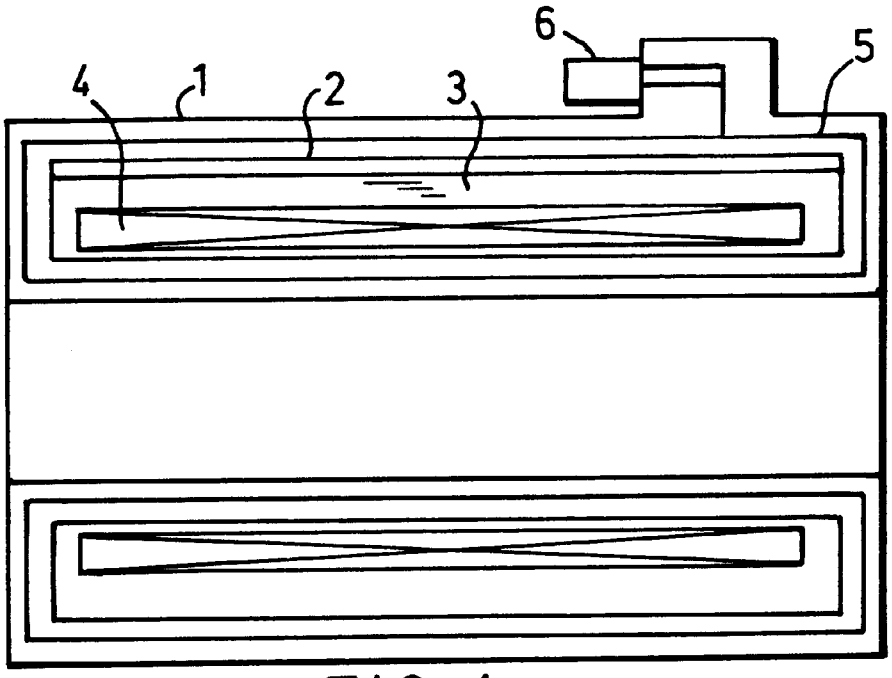
FIG. 1 (PRIOR ART)
FIG. 1 is a schematic diagram of superconductive magnet of liquid helium dunk cooling method according to the prior art.
Figure 2:
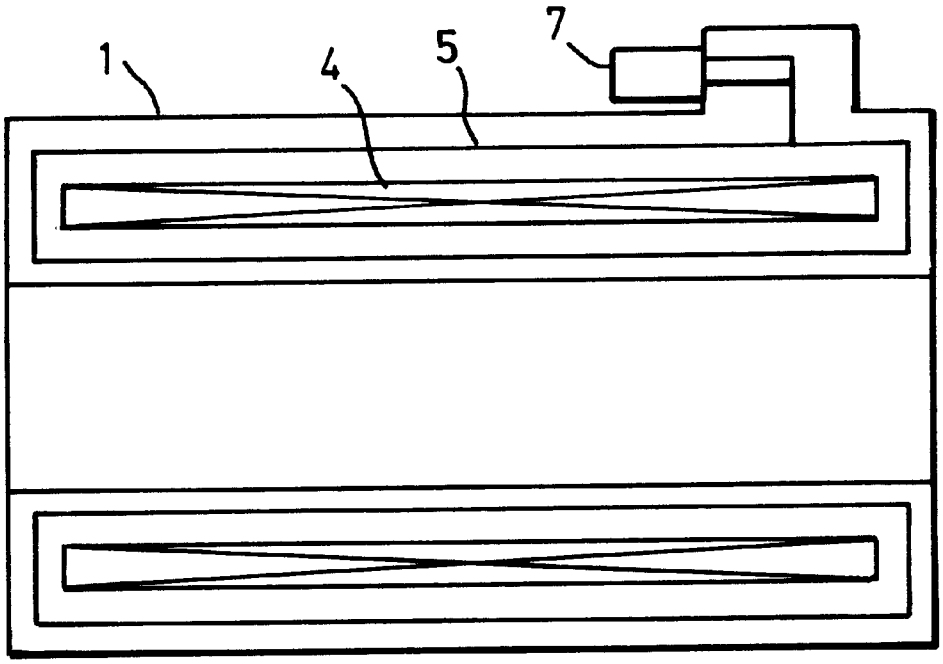
FIG. 2 (PRIOR ART)
FIG. 2 is a schematic diagram of superconductive magnet of conductive cooling method according to the prior art.
Figure 3:
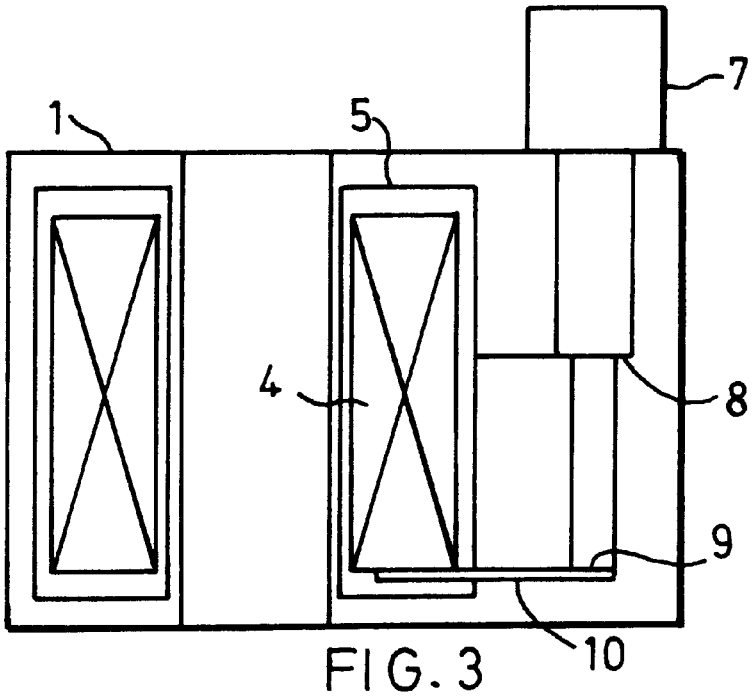
FIG. 3 (PRIOR ART)
FIG. 3 is a schematic diagram of another superconductive magnet of conductive cooling method according to the prior art.
Figure 4:
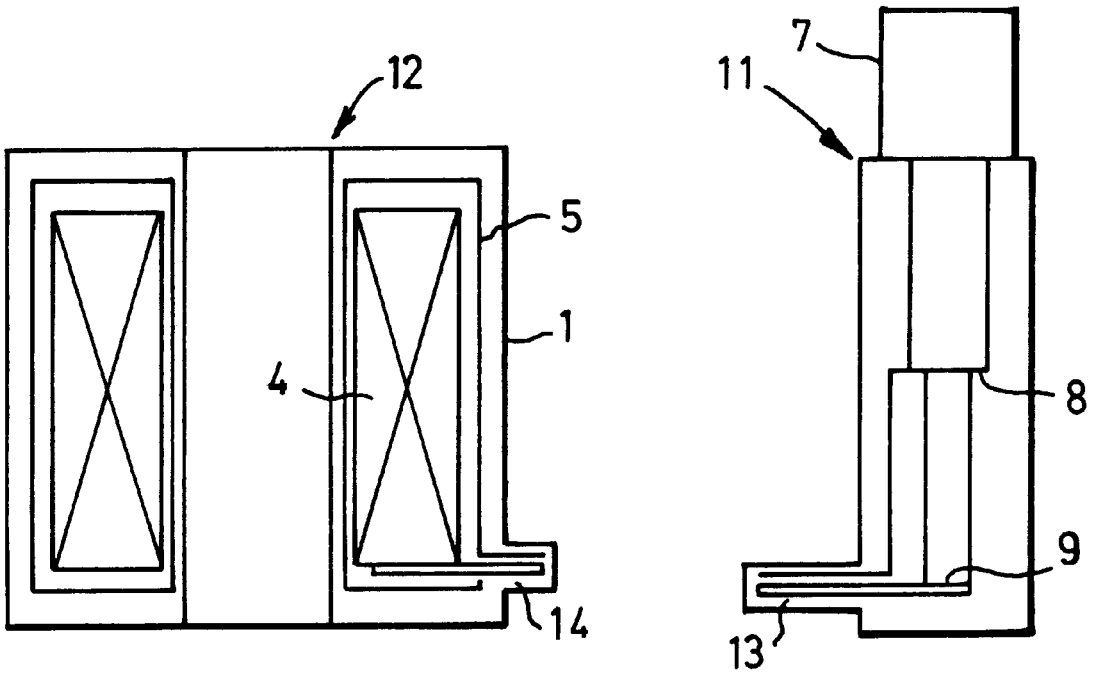
FIG. 4 (PRIOR ART)
FIG. 4 is a schematic diagram of superconductive magnet of cold accumulation method.
Figure 5:
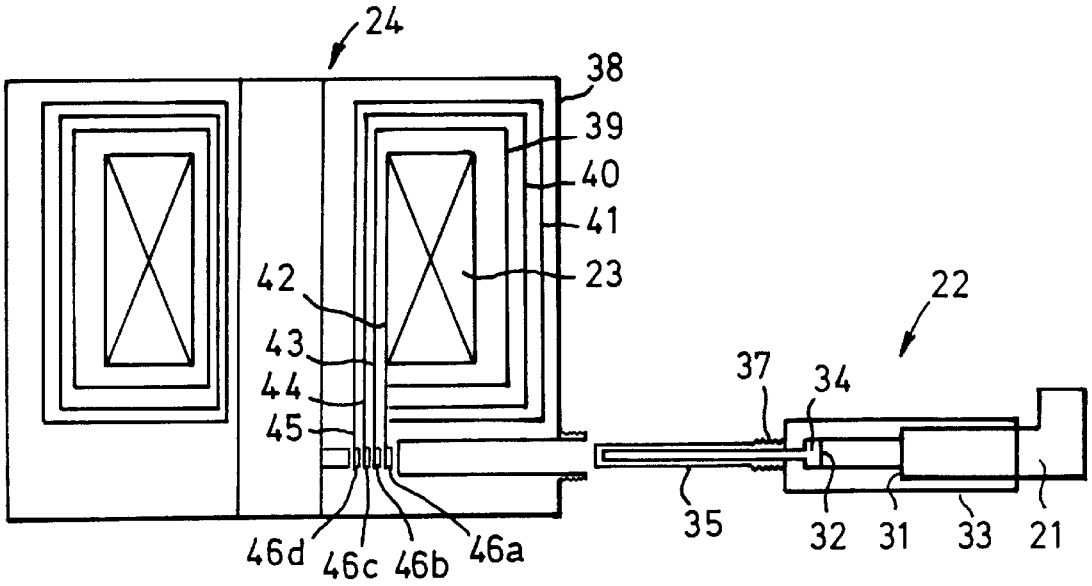
FIG. 5 is a schematic diagram of adiabatic apparatus according to a first embodiment of the present invention.

FIG. 5 is a block diagram of adiabatic apparatus according to a first embodiment of the present invention. In FIG. 5, as an object whose temperature is controlled, the superconductive coil of a cold reserved object is cooled below 10 K(superconductive transition temperature) and reserved in this temperature. The adiabatic apparatus is comprised of a cooling unit 22 whose main body is a cryogenic refrigerator 21 and an adiabatic vessel 24 to take in the superconductive coil 23. The cryogenic refrigerator 21 installed in the cooling unit 22 is GM refrigerator of two stage expansion method. The first cooling stage 31 is cooled to 70 K and the second cooling stage 32 is cooled to 4 K. These first cooling stage 31 and second cooling stage 32 are covered by a vacuum vessel 33. One side of a heat conduction member 34 is thermally connected to the second cooling stage 32. Other side of the heat conduction member 34 is extended to a heat conduction mechanism 35 thermally connected to outside in the vacuum vessel 33. This heat conduction mechanism 35 is thermally connected without vacuum-break through expansion wall 37. However, in same way of FIG. 4, this mechanism 35 may be composed by combination of the expansion wall and a vacuum valve.

Figure 6:
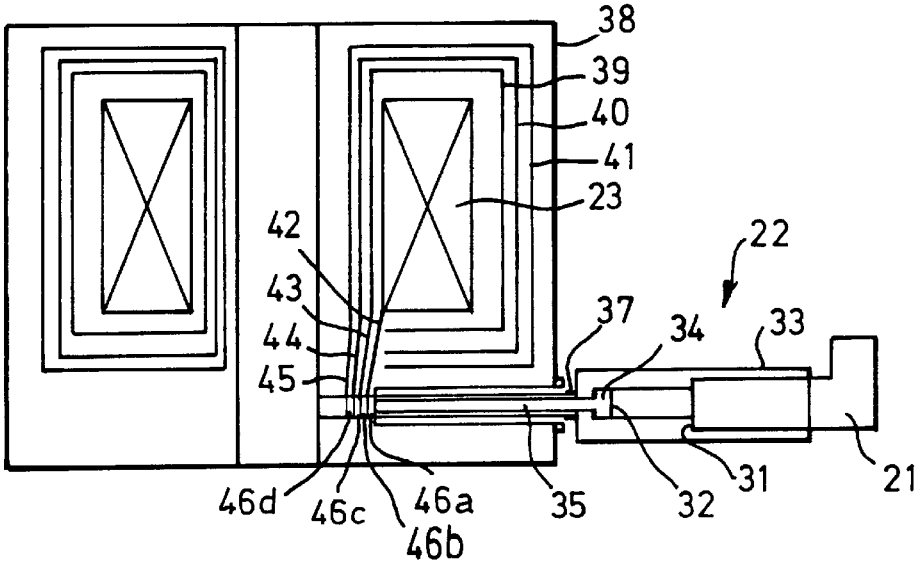
FIG. 6 is a schematic diagram of the adiabatic apparatus in which thermal switch section turns on according to the first embodiment of the present invention.

On the other hand, the adiabatic vessel 24 includes a vacuum vessel 38 in which the superconductive coil 23 is taken. These thermal shield plates 39, 40, 41 are located to surround the superconductive coil 23 in the vacuum vessel 38. These thermal shield plates 39, 40, 41 are consisted of ErNi layer, Er3Ni layer and Cu layer, whose thickness is approximately 2 mm. Heat transfer plates 42, 43, 44, 45 are respectively extended from the superconductive coil 23 and the thermal shield plates 39, 40, 41 to thermal switch sections 46*a*, 46*b*, 46*c*, 46*d*. The thermal switch sections 46*a*, 46*b*, 46*c*, 46*d* are cooled by thermally connecting to heat conduction mechanism 35 as shown in FIG. 6. The thermal switch sections 46*a~d* and the heat conduction mechanism 35 may be composed by combination of the expansion wall and the vacuum valve without vacuum-break. In FIG. 5, a power lead and a persistent current switch set to the superconductive coil 23 are omitted. Control line of the power lead and the persistent current switch are connected to outside through the heat conduction mechanism 35, 34. The vacuum vessel 38 is exhausted as $10^{-6}$ Torr. Furthermore, mechanical support of each section in the adiabatic vessel 24 is as follows (not shown in Fig.) A thermal shield plate 41 is supported to the vacuum vessel 38 through rosin member (FRP) a thermal shield plate 40 is supported to the thermal shield plate 41 through the rosin member, a thermal shield plate 39 is supported to the thermal shield plate 40 through the rosin member and the superconductive coil 23 is supported to the thermal shield plate 31 through the rosin member.

In this adiabatic apparatus, in order to cool the superconductive coil 23 to superconductive transition temperature and transfer to persistent current mode, the heat conduction mechanism 35 of the cooling unit 22 is thermally connected to the thermal switch sections 46*a~d* of the adiabatic vessel 24 as shown in FIG. 5. In this way, the heat conduction mechanism 35 is thermally connected to each heat transfer plate 42, 43, 44, 45 and the thermal switch section 46 turns "ON". In this situation, the superconductive coil 23 and the thermal shield plates 39, 40, 41 are thermally connected to the second cooling stage 32 of the cryogenic refrigerator 21 through the heat transfer plates 42, 43, 44, 45 and the heat conduction member 34. While the cryogenic refrigerator 21 is activated, the first cooling stage is cooled as 70 K, the second cooling stage and the heat conduction member 34 is cooled as 4 K. After predetermined time, the thermal shield plates 39, 40, 41 and the superconductive coil 23 are cooled as 4 K. In short, the superconductive coil 23 is cooled below superconductive transition temperature.

In such situation, after the superconductive coil 23 is transferred to the persistent current mode, the cooling unit 22 is separated from the adiabatic vessel 24. In this case, the heat transfer plates 42, 43, 44, 45 are thermally separated from the heat conduction mechanism 35 and the thermal switch section turns "OFF". Accordingly, the superconductive coil 23 and each thermal shield plate 39, 40, 41 are thermally separated each other. Hereafter, the superconductive coil 23 is coolly reserved for a time determined by shielding effect of radiation heat of the thermal shield plates 39~41 and heat capacity of the superconductive coil 23. In this case, the superconductive coil 23 as a cold reserved object and the thermal shield plate 39, 40, 41 are cold as same temperature at initialization mode. Heat leakage into the superconductive coil 23 is determined by temperature difference between the superconductive coil 23 and the thermal shield plate 39. Accordingly, the heat leakage does not almost exist. Heat entered from the vacuum vessel 38 is conducted into the thermal shield plate 41 located at most outer side. Therefore, temperature of the thermal shield plate 41 rises. Then, temperature difference between the thermal shield plate 41 and the thermal shield plate 40 arises and heat leakage into the thermal shield plate 40 increases. In this case, temperature of the thermal shield plate 40 becomes to rise behind the thermal shield plate 41. Therefore, temperature difference between the thermal shield plate 40 and the thermal shield plate 39 arises and heat leakage into the thermal shield plate 39 increases. In this case, temperature of the thermal shield plate 39 becomes to rise behind the thermal shield plate 40. Then, temperature difference between the thermal shield plate 39 and the superconductive coil 23 arises and heat leakage into the superconductive coil 23 increases. Temperature of the superconductive coil 23 becomes to rise. However, this temperature becomes to rise after temperature of the thermal shield plates 39, 40, 41 surrounding the coil 23 gradually rise. Especially, before temperature of the thermal shield plate 39 rises, the heat leakage into the superconductive coil 23 is remained as a little quantity for a long time. Accordingly, cold reserved time of the superconductive coil 23 is sufficiently prolonged.

As mentioned-above, in the present invention, cold reserved time is sufficiently prolonged. In this case, the thermal shield plate is cooled as same temperature of the cold reserved object (superconductive coil). Because the heat leakage into the cold reserved object does not almost arise if temperature difference between the cold reserved object and the thermal shield plate is a little. In this case, at initialization made of cooling, cooling source is commonly used for the cold reserved object and the thermal shield plate.

Figure 7:
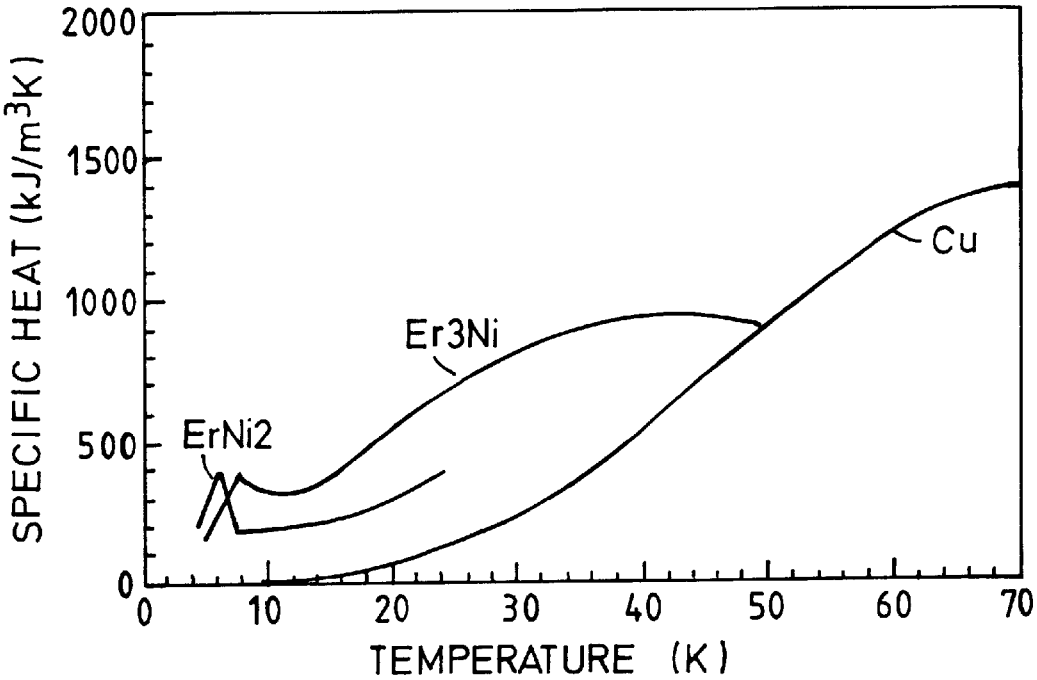
FIG. 7 is a graph showing specific heat characteristics of magnetic material which specific heat is large around magnetic transition temperature.

As temperature of the thermal shield plate rises in proportion to time, heat leakage into the cold reserved object becomes to increase. Therefore, rise of temperature of the thermal shield plate is necessary to be suppressed. As one method, the thermal shield plate is consisted of material of large specific heat, such as magnetic material (for example, Er3Ni). As shown in FIG. 7, the magnetic material has a peak of large specific heat around magnetic transition temperature. Actually, in comparison with thermal shield plate consisted of copper, cold reserved time of the magnetic material increases as almost ten times.

Figure 8:
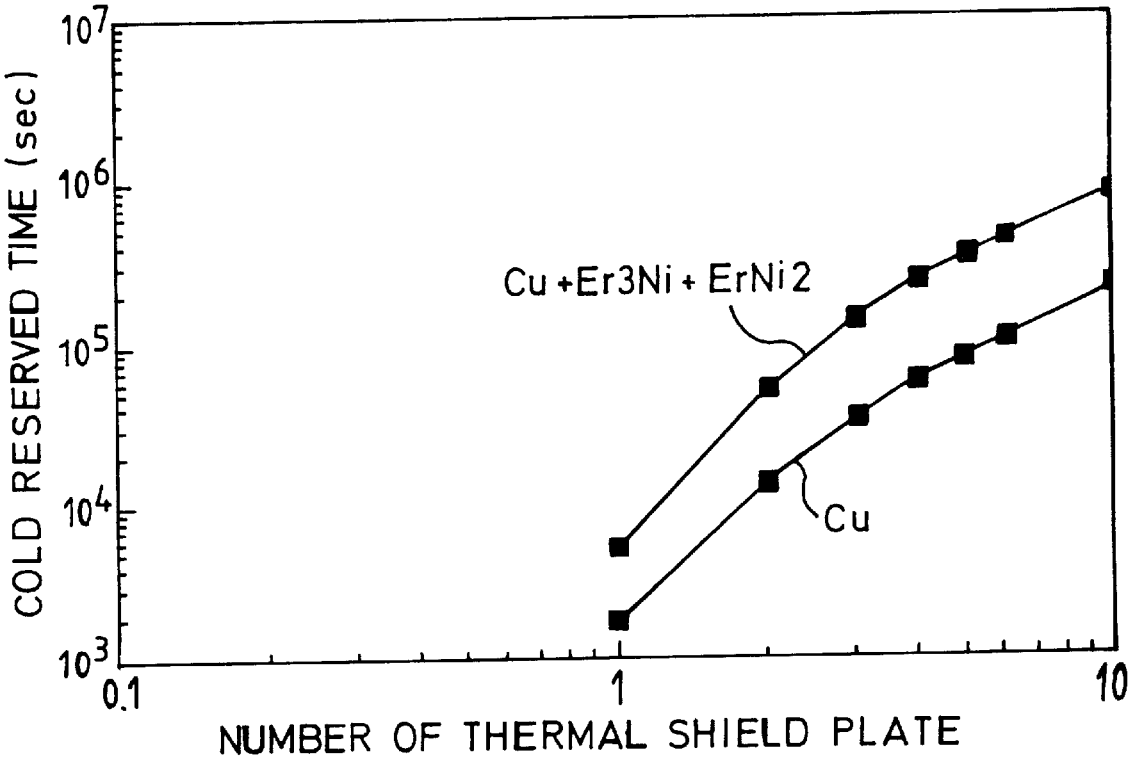
FIG. 8 is a graph showing relation between number of thermal shield plates and the cold reserved time.

As another method, as mentioned in the first embodiment, second thermal shield plate is located outside of first thermal shield plate. Temperature of the second thermal shield plate is remained as same of the first thermal shield plate. In same way, a plurality of thermal shield plates (third, fourth) concentrically surround the cold reserved object and these temperature is controlled. FIG. 8 shows a graph of relation between cold reserved time and number of thermal shield plate in case of fixed capacity. As shown in FIG. 8, as the number of the thermal shield plate increases, the cold reserved time is prolonged. Especially, if the number of the thermal shield plate is above two, this effect is remarkable. In this way, in the present invention, a plurality of the thermal shield plates concentrically surround the cold reserved object in order, and temperature of the plurality of the thermal shield plates is controlled as same as the cold reserved object. Therefore, the cold reserved time is sufficiently prolonged.

Figure 9:
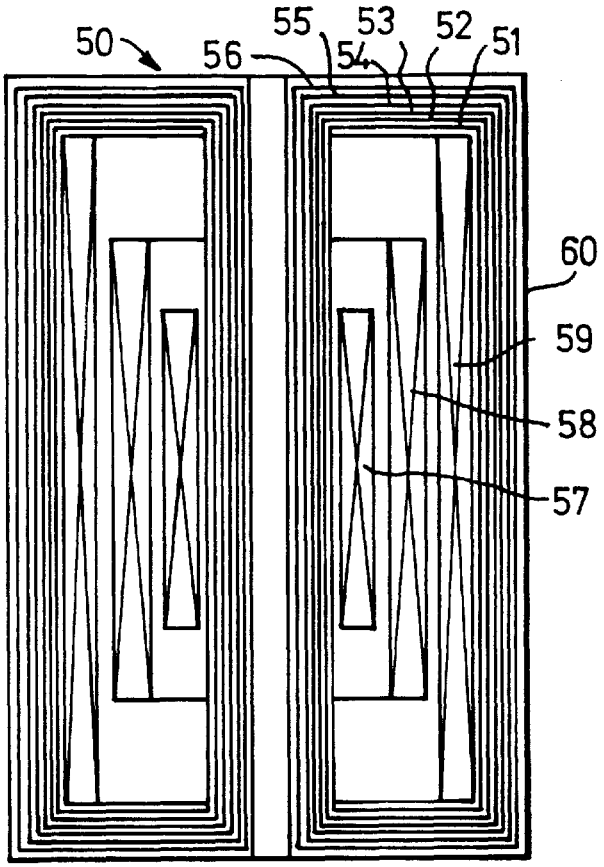
FIG. 9 is a schematic diagram of adiabatic apparatus according to a second embodiment of the present invention.

FIG. 9 is a block diagram of the adiabatic vessel 50 according to a second embodiment. As shown in FIG. 9, in a vacuum vessel 60, six thermal shield plates 51~56 and three superconductive coils 57~59 are initially cooled by a second cooling stage (4 K) of GM refrigerator of two-stage expansion method. In same way of the first embodiment, while the cryogenic refrigeration (not shown in FIG. 9 ) is activated, the thermal shield plates 51~56 and the superconductive coils 57~59 are cooled as 4 K after predetermined time. In this situation, after transferring to persistent current mode, the cooling unit (not shown in FIG. 9) is separated from the adiabatic vessel 50 and thermal switch section (not shown in FIG. 9) turns "OFF". In short, the superconductive coils 57~59 and each thermal shield plate are thermally separated from outside. Hereafter, the superconductive coils 57~59 are coolly reserved as time determined by shielding effect of radiation heat of the thermal shield plates 51~56 and heat capacity of the superconductive coils 57~59.

Figure 10:
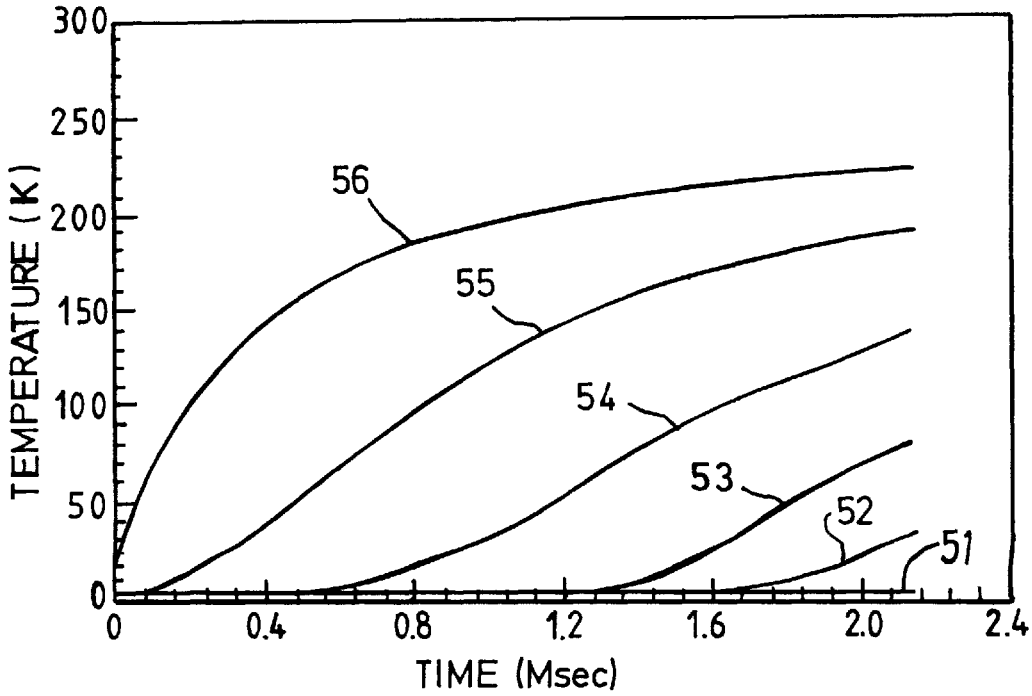
FIG. 10 is a graph showing temperature change of the thermal shield plates.
Figure 11:
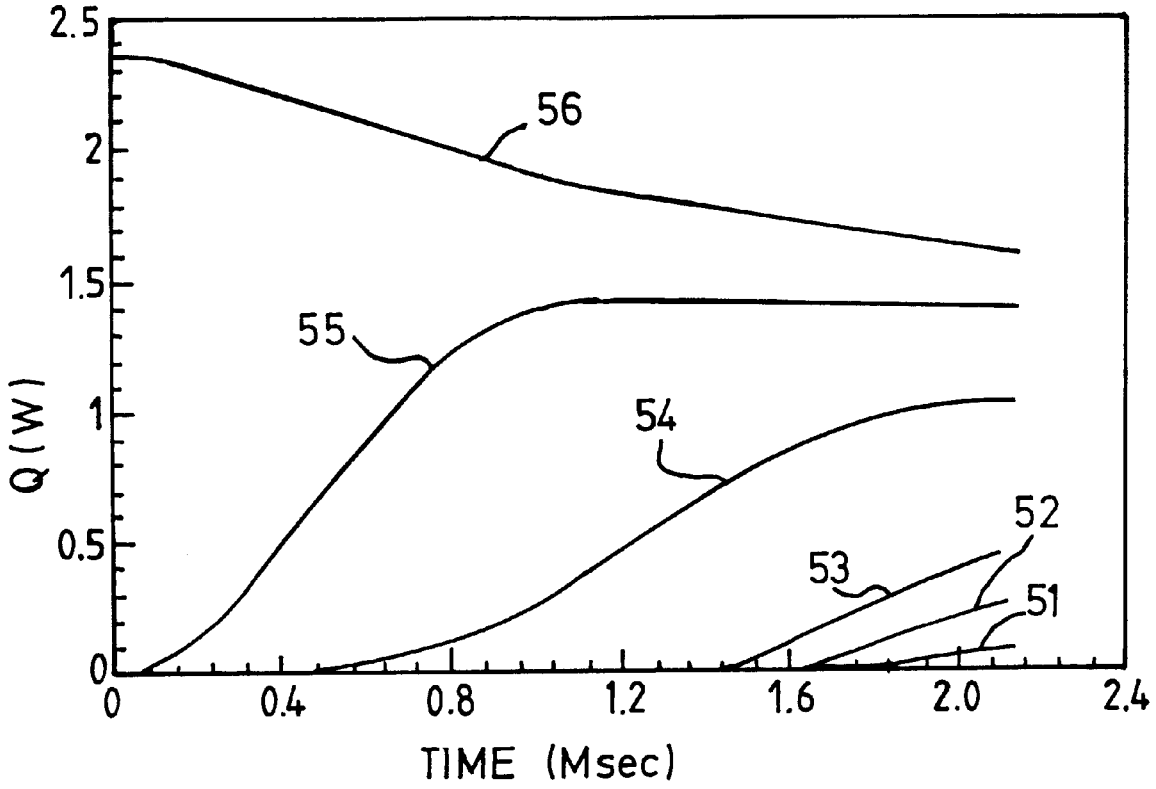
FIG. 11 is a graph showing change of heat transfer quantity of the thermal shield plates.

FIG. 10 is a graph showing temperature change of each thermal shield plate 51~56 in case the adiabatic vessel 50 is initially cooled and separated from the cooling unit. FIG. 11 is a graph showing heat transfer quantity (Q) of each interval of neighboring thermal shield plate. In this adiabatic vessel 50, the superconductive coils 57~59 are coolly reserved below 4.6 K for twenty days(1.7 Msec).

Figure 12:
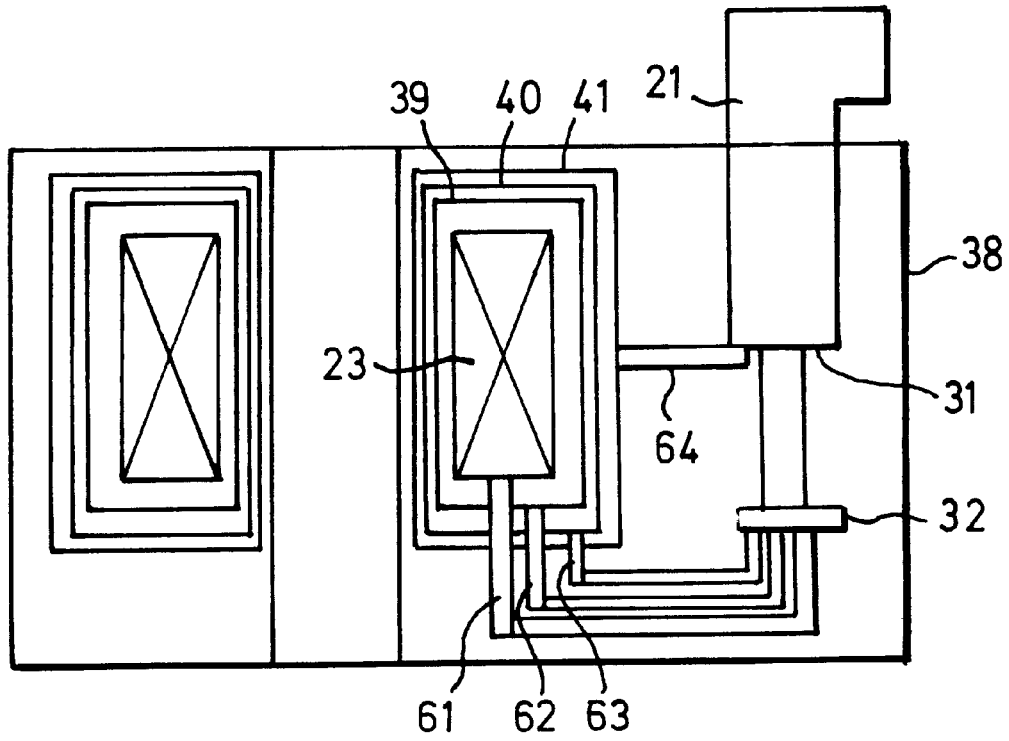
FIG. 12 is a schematic diagram of adiabatic apparatus according to a third embodiment of the present invention.
Figure 13:
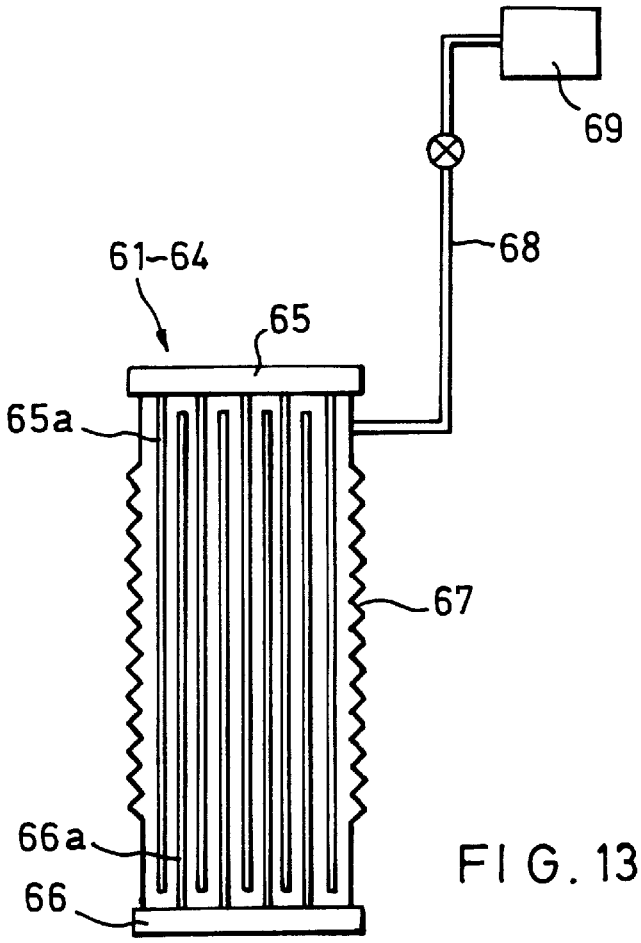
FIG. 13 is a schematic diagram of thermal switch used in the adiabatic apparatus according to the present invention.

FIG. 12 is a block diagram of the adiabatic apparatus according to a third embodiment. In this adiabatic vessel, the superconductive coil is cooled below 1OK(superconductive transition temperature). In same way of the first embodiment, the superconductive coil 23 and three thermal shield plates 39, 40, 41 are initially cooled by GM refrigerator of two-stage expansion method. However, different from the first embodiment, the refrigerator 21 is remained to be mounted to a vacuum vessel 38 and adiabatic is executed by "ON-OFF" of thermal switch only. Concretely speaking, the superconductive coil 23 and two thermal shield plates 39, 40 surrounding the coil 23 are connected to a second cooling stage 23 of a cryogenic refrigerator 21 through thermal switch 61, 62, 63. A thermal shield plate 40 of most outer layer is connected to a first cooling stage 31 of the cryogenic refrigerator 21 through a thermal switch 64. FIG. 13 is a schematic diagram of the thermal switches 61~64. In order for the thermal switches 61~64 to turn "ON/OFF", a supply/exhaust apparatus 69 supplies/exhausts heat conduction gas(for example, helium gas) to a cylinder 67, whose both sides are covered by heat transfer plates 65, 66, through a tube 68. In the cylinder 67, projection plates 65*a* of a heat transfer plate 65 face to projection plates 66*a* of a heat transfer plate 66 each other as insert die condition. By supplying helium gas to the cylinder 67 through the tube 68, heat is transferred between two heat transfer plates 65, 66 by using heat conduction of helium gas and the thermal switch turns "ON". By exhausting helium gas from the cylinder 67 through the tube 68, inside of the thermal switch becomes to be vacuum. Therefore, heat is not transferred between two heat transfer plates 65, 66 and the thermal switch turns "OFF".

Assume that each thermal switch 61~64 turns "ON" by supplying helium gas and the cryogenic refrigerator 21 begins to activate. The first cooling stage 31 cools the thermal shield plate 41 through the thermal switch 64, and the second cooling stage 32 cools the thermal shield plate 39, 40 and the superconductive coil 23 through the thermal switch 61, 62, 63. After sufficient time, temperature of the thermal shield plate 41 is almost same as the first cooling stage 31, and temperature of the thermal shield plates 39, 40 and the superconductive coil 23 is almost same as the second cooling stage 32. In this case, each thermal switch 61~64 turns "OFF" by exhausting helium gas. Each thermal shield plate 39~41 and the superconductive coil 23 are thermally separated from the first and the second cooling stage 31, 32. Activation of the cryogenic refrigerator 21 is stopped. Hereafter, the superconductive coil 23 is coolly reserved as time determined by shielding effect of radiation heat of the thermal shield plates 39~41 and heat capacity of the superconductive coil 23.

In FIG. 13, the thermal switch is gas-pressure switch by controlling gas-pressure of heat conductivity. However, the thermal switch is not limited to this. However, as for a first heat transfer body, a second heat transfer body is set to relatively movable through driving mechanism. By mechanically moving the first and second heat transfer body, thermal switch can turn ON/OFF as contact/non-contact. When the second heat transfer body contacts the first heat transfer body, the heat is transferred (ON). When the second heat transfer body does not contact the first heat transfer body, the heat is not transferred (OFF).

Figure 14:
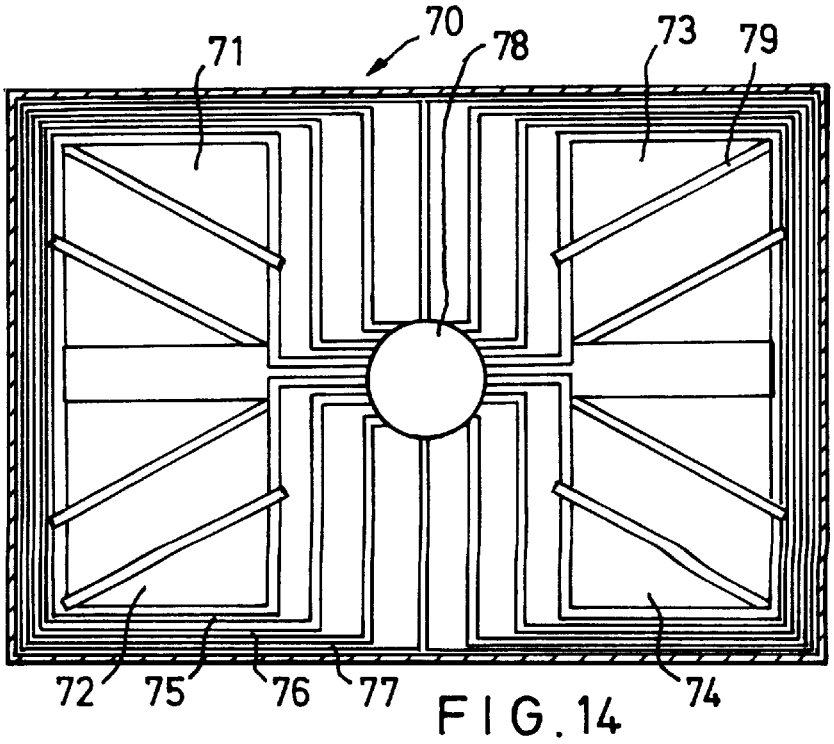
FIG. 14 is a schematic diagram of adiabatic apparatus according to a fourth embodiment of the present invention.

FIG. 14 is a block diagram of the adiabatic apparatus according to the fourth embodiment. In the fourth embodiment, High-Tc superconductive bulk whose critical temperature is high is used instead of superconductive coil. Concretely speaking, in adiabatic vessel 70 of FIG. 14, High-Tc superconductive bulks 71~74 whose critical temperature is 80 K and three thermal shield plates 75~77 surrounding the bulk are initially cooled by GM refrigerater of cooling stage (70 K) of one-stage expansion method. In FIG. 14, 78 represents a connection of cooling unit and 79 represents support member for High-Tc superconductive bulk. After the cryogenic refrigerator is activated for predetermined time, the thermal plates 75~77 and High-Tc superconductive bulk 71~74 are cooled as 70 K. In this situation, the cooling unit is separated from the adiabatic vessel to turn off the thermal switch. The High-Tc superconductive bulk 71~74 and each thermal shield plates 75~77 are thermally separated from outside. Hereafter, the High-Tc superconductive bulk 71~74 are coolly reserved for a time determined by shielding effect of radiation heat of the thermal shield plates 75~77 and heat capacity of the High-Tc superconductive bulk.

Figure 15A:
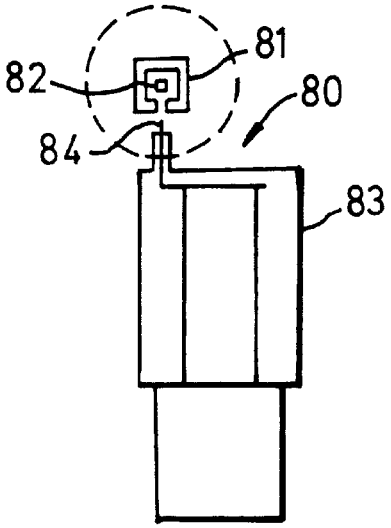
FIG. 15 is a schematic diagram of adiabatic apparatus according to a fifth embodiment of the present invention.
Figure 15B:
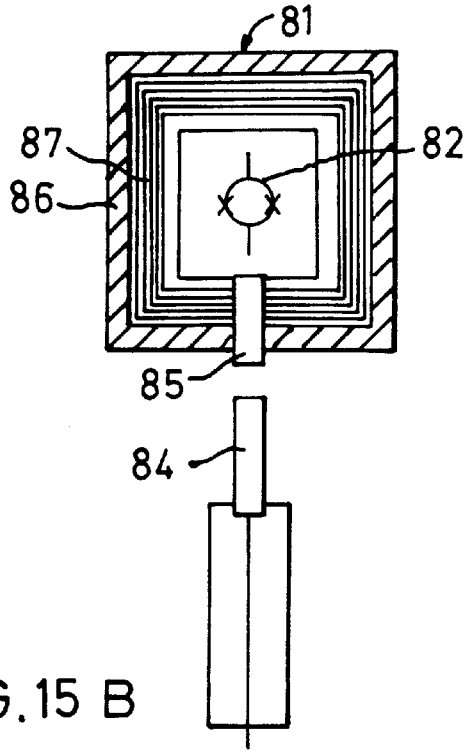

FIG. 15A is a schematic diagram of the adiabatic apparatus 80 according to the fifth embodiment, and FIG. 15B is a magnification chart of main part of the adiabatic apparatus 80. In the fifth embodiment, SQUID (Superconductive Quantum Interference Device) 82 of High-Tc superconductor stored in the adiabatic vessel 81 is coolly reserved below 80 K. In FIG. 15A and 15B, 83 represents cooling unit, 84•85 represent thermal switch, 86 represents vacuum vessel, 87 represents a plurality of thermal shield plates initially cooled as same temperature as SQUID 82. After the cryogenic refrigerator is activated for predetermined time, the thermal shield plate 87 and SQUID 82 are cooled. In this situation, the cooling unit 83 is separated from the adiabatic vessel to turn off the thermal switch. SQUID 82 and the thermal shield plate 87 are thermally separated from outside. Hereafter, SQUID 82 is coolly reserved for a time determined by shielding effect of radiation heat of the thermal shield plate 87 and heat capacity of SQUID 82.

Figure 16:
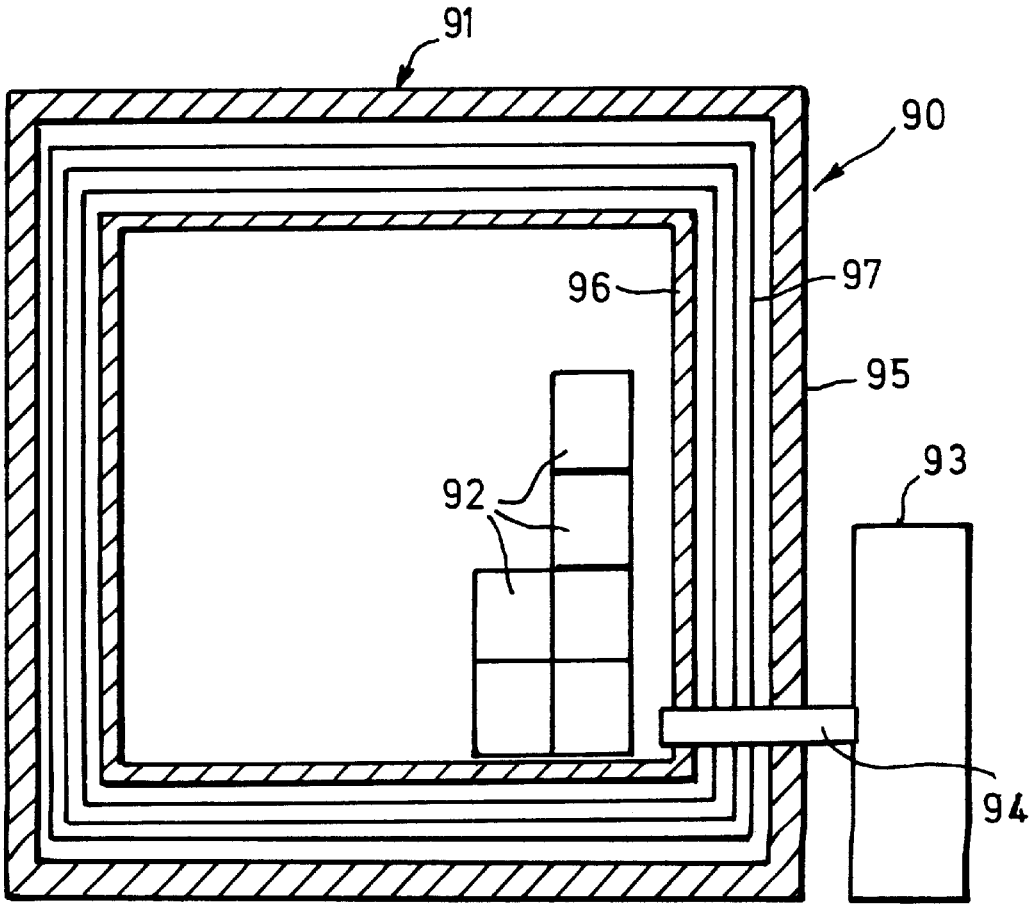
FIG. 16 is a schematic diagram of adiabatic apparatus according to a sixth embodiment of the present invention.

FIG. 16 is a schematic diagram of the adiabatic apparatus 90 according to the sixth embodiment. In the sixth embodiment, frozen foods 92 in the adiabatic vessel 91 are coolly reserved below −20° C. In FIG. 16, 93 represents a cooling unit, 94 represents a thermal connector, 95 represents a vacuum vessel, 96 represents an inner vessel, 97 represents a plurality of thermal shield plates initially cooled as same temperature as the frozen foods 92. After the refrigerator is activated for predetermined time, the thermal shield plate 97 and the frozen foods 92 are cooled. In this situation, the cooling unit 93 is separated from the adiabatic vessel 91 to turn off the thermal switch. The frozen foods 92 and the thermal shield plate 97 are thermally separated from outside. Hereafter, the frozen foods 92 is coolly reserved for a time determined by shielding effect of radiation heat of the thermal shield plate and heat capacity of the frozen foods.

Figure 17:
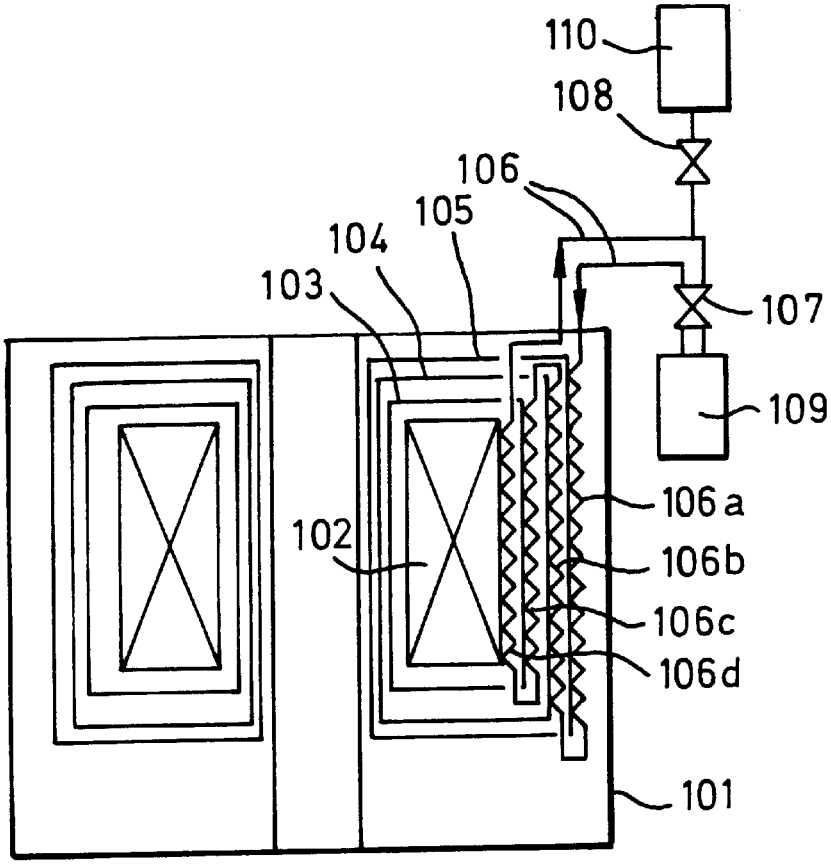
FIG. 17 is a schematic diagram of adiabatic apparatus according to a seventh embodiment of the present invention.

FIG. 17 is a schematic diagram of the adiabatic apparatus according to the seventh embodiment. In this embodiment, the adiabatic apparatus is comprised of a vacuum vessel 101, a superconductive coil 102 stored in the vacuum vessel 101, three shield plates 103~105 surrounding the superconductive coil 102, a coolant supply apparatus 109 and an exhaust apparatus 110 connected by cooling tube 106 and valve 107, 108. The cooling tube 106 guided from outside into the vacuum vessel 101 partially includes heat exchangers 106*a*~106*c* thermally connected by the thermal shield plates 103~105. In this case, the superconductive coil 102 is thermally connected to the heat exchanger 106*d* surrounding the superconductive coil 102. The cooling tube 106 is finally guided to outside through passing in this way. Concretely speaking, cooling liquid helium is flown from the coolant supply apparatus 109 to the vacuum vessel 101 through the valve 107 and the tube 106. During flowing the cooling liquid helium, the heat exchangers 106*a*~106*d* heatly exchange the thermal shield plates 103~105 and the superconductive coil 102 to cool them. When temperature of each thermal shield plate 103~105 and the superconductive coil 102 reaches to liquid helium temperature (4.2 K), electric current is supplied to the superconductive coil 102 by power lead (not shown in FIG. 17). The superconductive coil is transmitted to persistent current mode by persistent current switch (not shown in FIG. 17). At this timing, supply of the liquid helium is stopped by controlling the coolant supply apparatus 109 and valve 107. After this, inside of the tube 106 is exhausted as vacuum by controlling the exhaust apparatus 110 and the valve 108. After vacuum-exhaustion, inside of the tube becomes to be vacuum by closing the valve 107, 108. In this way, heat leakage from the tube 106 decreases as status of adiabatic. Hereafter, the superconductive coil is coolly reserved as a time determined by shielding effect of radiation heat of the thermal shield plate and heat capacity of superconductive coil.

Figure 18:
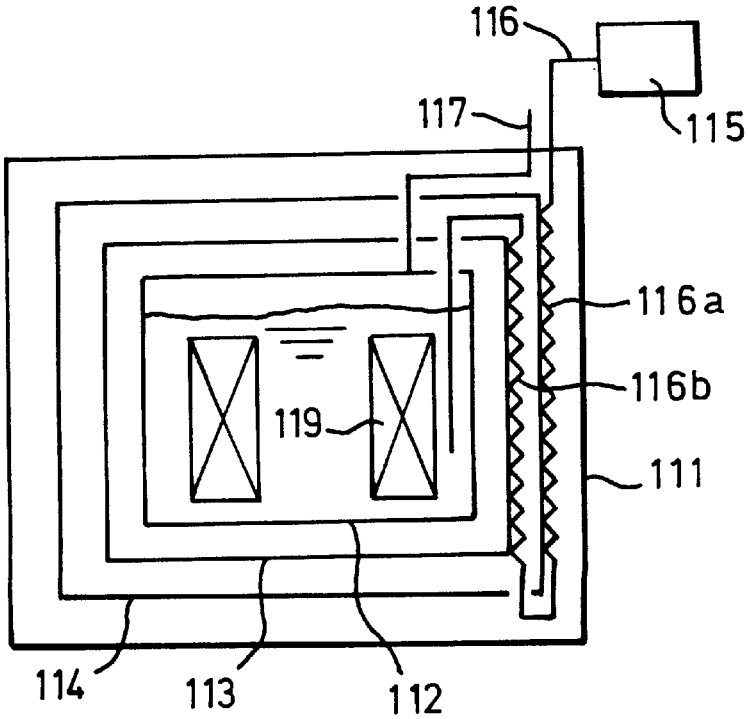
FIG. 18 is a schematic diagram of adiabatic apparatus according to an eighth embodiment of the present invention.

FIG. 18 is a schematic diagram of the adiabatic apparatus according to the eight embodiment. In this embodiment, the adiabatic apparatus is comprised of a vacuum vessel 111, a liquid helium vessel 112 stored in the vacuum vessel 111, two shield plates 113•114 surrounding the liquid helium vessel 112, helium supply apparatus 115, helium tube 116 whose one side is connected to the helium supply apparatus and other side is connected into the liquid helium vessel 112, exhaust tube 117 whose one side is connected to the liquid helium vessel 112 and other side is connected to outside through the vacuum vessel 111. In the liquid helium vessel 112, a cold reserved object such as the superconductive coil 119 is stored. The helium tube 116 partially includes two heat exchangers 116*a*•116*b* to heatly exchange to the thermal shield plates 113•114, and is guided from the supply apparatus 115 to the vacuum vessel 111. The heat exchanger 116*a*•116*b* thermally connects to the thermal shield plates 113•114 during supplying liquid helium. The helium tube 116 is finally guided into the liquid helium vessel 112. The liquid helium is flown from the helium supply apparatus 115 into the helium tube 116, cools the thermal shield plate 113•114 by heatly exchanging to the heat exchangers 116*a*•116*b*, and flown into the liquid helium vessel 112 to cool the superconductive coil 119. When the thermal shield plate 113•114 and the superconductive coil 119 are cooled to liquid helium temperature (4.2 K), and the liquid helium is stayed in the liquid helium vessel 112, electric current is supplied to the superconductive coil 119 by power lead (not shown in FIG. 18). After the superconductive coil 119 is transmitted to persistent current mode by persistent current switch (not shown in FIG. 18), supply of the liquid helium is stopped by controlling the helium supply section 115. The superconductive coil 119 is coolly reserved as a time determined by shield effect of radiation heat of the thermal shield plates 113•114 and heat capacity of the helium vessel 112, the liquid helium and the superconductive coil 119. In this case, the helium tube 117 may be closed up by a lid out of the vacuum vessel 111. The thermal shield plate may be cooled by evaporation gas.

Figure 19:
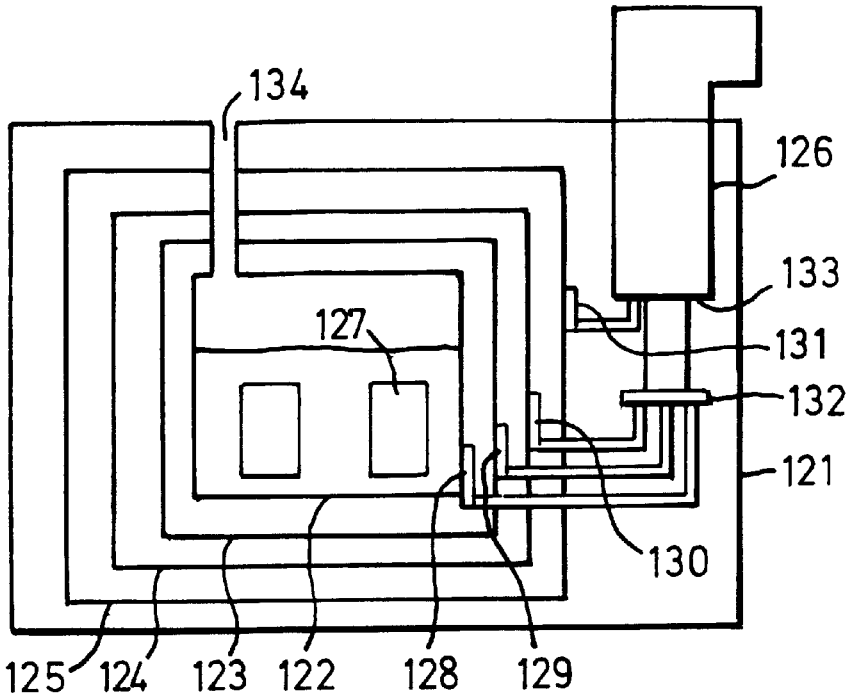
FIG. 19 is a schematic diagram of adiabatic apparatus according to a ninth embodiment of the present invention.

FIG. 19 is a schematic diagram of the adiabatic apparatus according to the ninth embodiment. In this embodiment, the adiabatic apparatus is comprised of a vacuum vessel 121, a liquid helium vessel 122 stored in the vacuum vessel 121, three thermal shield plates 123~125 surrounding the liquid helium vessel 122, and two-stage GM refrigerator 126. A superconductive coil 127 is stored in the liquid helium vessel 122. The liquid helium vessel 122 and the thermal shield plates 123•124 of inner two layer are thermally connected to the second cooling stage 132 of the refrigerator 126 through thermal switch 128~130 respectively. The thermal shield plate 125 of most outer side is thermally connected to the first cooling stage 133 of the refrigerator 126 through thermal switch 131. As construction of the thermal switches 128~131, gas-pressure switch may be used as shown in FIG. 13. A liquid helium supply tube 134 is guided from the liquid helium vessel 122 to outside through the vacuum vessel 121. By supplying the liquid helium from the tube 134 to the liquid helium vessel 122, the thermal switches 128~131 turns "ON" and the refrigerator 126 begins to activate. The first cooling stage 133 cools the thermal shield plate 125 through the thermal switch 131 and the second cooling stage 132 cools the thermal shield plates 122~124 through the thermal switches 128~130 respectively. After passing sufficient time, temperature of the thermal shield plate 125 becomes to be equal to temperature (40 K) of the first cooling stage 133 and temperature of the thermal shield plates 122~124 becomes to be equal to temperature (4 K) of the second cooling stage 132. Furthermore, the liquid helium is stayed as necessary quantity in the liquid helium vessel. In this case, electric current is supplied to the superconductive coil 127 by power lead (not shown in FIG. 19) and the superconductive coil 127 is transmitted to persistent current mode by persistent current switch (not shown in FIG. 19). Furthermore, the helium gas in the thermal switch 128~131 is exhausted to turn off the thermal switch. Each thermal shield plate 122~125, the first and the second cooling stage 132•133 are thermally separated to stop activation of the refrigerator 126. Hereafter, the liquid helium vessel, the liquid helium and the superconductive coil are coolly reserved for a time determined by shielding effect of radiation heat of the thermal shield plate and heat capacity of the superconductive coil. In this case, the helium tube 134 may be closed up by a lid out of the vacuum vessel 121. The shield plate may be cooled by evaporation gas.

Figure 20:
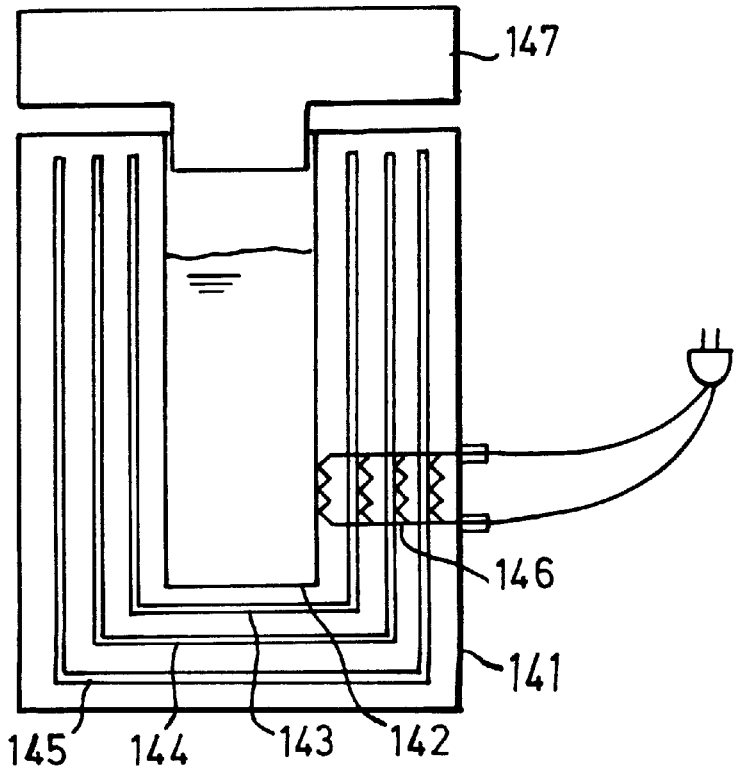
FIG. 20 is a schematic diagram of adiabatic apparatus according to a tenth embodiment of the present invention.

FIG. 20 is a schematic diagram of adiabatic apparatus according to the tenth embodiment. In this embodiment, a kind of object to be controlled temperature is changed to a cold reserved object to a heat reserved object. The adiabatic apparatus is consisted of a vacuum vessel 141, a liquid vessel 142 stored in the vacuum vessel 141, three shield plates 143~145 surrounding the liquid vessel 142, a heater 146 and a lid 147. For example, liquid to be heated such as water or coffee is poured in the liquid vessel 142 and its temperature rise by turning on the heater 146. In this case, the heater 146 is thermally connected to the liquid vessel 142 and three thermal shield plates 143~145. The liquid vessel 142 and the thermal shield plates 143~145 are heated at same time. When temperature of liquid in the liquid vessel 142 to predetermined time (for example, 95° C.), activation of the heater 146 is stopped. In this case, temperature of each thermal shield plate 143~145 is almost same as or above the temperature of liquid to be heated. In case of turning off the heater 146, heating of the thermal shield plates 143~145 is stopped. Hereafter, the heated liquid is heatly reserved for a time determined by shielding effect of radiation heat of the thermal shield plate 143~145 and heat capacity of the heated liquid. Whereas adiabatic vessel of prior art executes heating by frequently turning ON/OFF of the heater, the adiabatic vessel of the present invention can heatly reserve for a long time only by initial heating without hereafter heating.

What is claimed is:

1. An adiabatic apparatus, comprising:

a vessel including an adiabatic layer in which an object is taken;

a plurality of thermal shield plates located in the adiabatic layer, each of which concentrically surrounds the object in order;

temperature control means for cooling or heating the object and the plurality of thermal shield plates; and switch means for thermally connecting said temperature control means to the plurality of thermal shield plates and the object if temperature of the plurality of thermal shield plates and the object is controlled, and for thermally separating said temperature control means from the plurality of thermal shield plates and the object if control of the temperature of the plurality of thermal shield plates and the object is completed.

2. The adiabatic apparatus according to claim 1, wherein said switch means thermally connects the plurality of thermal shield plates to the object if temperature of the plurality of thermal shield plates and the object is controlled.

3. The adiabatic apparatus according to claim 2, wherein said switch means thermally separates the plurality of thermal shield plates from the object if control of the temperature of the plurality of thermal shield plates and the object is completed, each thermal shield plate and the object are separated each other.

4. The adiabatic apparatus according to claim 1, wherein said temperature control means is installed to said vessel if said temperature control means is thermally connected to the plurality of thermal shield plates and the object, and said temperature control means is taken off from said vessel if said temperature control means is thermally separated from the plurality of thermal shield plates and the object.

5. The adiabatic apparatus according to claim 1, wherein temperature of the plurality of thermal shield plates is controlled to be nearly equal to temperature of the object.

6. The adiabatic apparatus according to claim 1, wherein at least one of the plurality of thermal shield plates is consisted of material of large specific heat.

7. The adiabatic apparatus according to claim 6, wherein the one of the plurality of thermal shield plates is magnetic material whose specific heat is large around magnetic transition temperature.

8. An adiabatic apparatus comprising:

a vessel including an adiabatic layer in which an object is taken, a plurality of thermal shield plates located in the adiabatic layer, each of which concentrically surrounds the object in order;

temperature control means including at least one temperature control stage for cooling or heating at predetermined temperature; and switch means for thermally connecting said one temperature control stage to the plurality of thermal shield plates and the object if temperature of the plurality of thermal shield plates and the object is controlled, and for thermally separating said one temperature control stage from the plurality of thermal shield plates and the object if control of the temperature of the plurality of thermal shield plates and the object is completed.

9. The adiabatic apparatus according to claim 8, wherein said one temperature control stage thermally connects the plurality of thermal shield plates to the object if temperature of the plurality of thermal shield plates and the object is controlled.

10. The adiabatic apparatus according to claim 9, wherein said one temperature control stage thermally separates the plurality of thermal shield plates from the object if control of the temperature of the plurality of thermal shield plates and the object is completed.

11. The adiabatic apparatus according to claim 8, wherein said temperature control means is installed to said vessel if said one temperature control stage is thermally connected to the plurality of thermal shield plates and the object, and said temperature control means is taken off from said vessel if said one temperature control stage is thermally separated from the plurality of thermal shield plates and the object.

12. The adiabatic apparatus according to claim 8, wherein temperature of the plurality of thermal shield plates is controlled to be nearly equal to temperature of the object.

13. The adiabatic apparatus according to claim 8, wherein at least one of the plurality of thermal shield plates is consisted of material of large specific heat.

14. The adiabatic apparatus according to claim 13, wherein the one of the plurality of thermal shield plate is magnetic material whose specific heat is large around magnetic transition temperature.

* * * * *